US010564587B2

(12) United States Patent
Okamoto

(10) Patent No.: US 10,564,587 B2
(45) Date of Patent: Feb. 18, 2020

(54) IMAGE FORMING APPARATUS

(71) Applicant: KYOCERA Document Solutions Inc., Osaka (JP)

(72) Inventor: Sueaki Okamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/368,434

(22) Filed: Mar. 28, 2019

(65) Prior Publication Data

US 2019/0354057 A1 Nov. 21, 2019

(30) Foreign Application Priority Data

May 16, 2018 (JP) ..... 2018-094309
May 16, 2018 (JP) ..... 2018-094310

(51) Int. Cl.
*G03G 15/16* (2006.01)
*G03G 15/00* (2006.01)

(52) U.S. Cl.
CPC ..... *G03G 15/657* (2013.01); *G03G 15/165* (2013.01); *G03G 2215/00409* (2013.01); *G03G 2215/00451* (2013.01); *G03G 2215/00679* (2013.01)

(58) Field of Classification Search
CPC .. G03G 15/657; G03G 15/165; G03G 15/161; G03G 15/2028; G03G 2215/16; G03G 2215/1666; G03G 2215/00679; G03G 2215/00451; G03G 2215/00409
See application file for complete search history.

(56) References Cited

U.S. PATENT DOCUMENTS 7,539,447 B2 * 5/2009 Hattori ..... G03G 15/165 399/316
8,005,412 B2 * 8/2011 Sakashita ..... G03G 15/657 399/315
9,436,134 B2 * 9/2016 Okamoto ..... G03G 15/657
2006/0171760 A1 8/2006 Deguchi ..... 400/642
2007/0269242 A1 11/2007 Hattori et al. ..... 399/316
2012/0027475 A1 * 2/2012 Ohba ..... G03G 15/1605 399/316

FOREIGN PATENT DOCUMENTS

JP 2006-208840 A 8/2006
JP 2008-26810 A 2/2008

* cited by examiner

*Primary Examiner* — Hoang X Ngo
(74) *Attorney, Agent, or Firm* — Stein IP, LLC

(57) ABSTRACT

An image forming apparatus includes an image carrier, a transfer member, a registration roller pair, and a conveyance guide. The conveyance guide includes a first conveyance guide which faces an image-carrier-side surface of the recording medium, and a second conveyance guide which faces a transfer-member-side surface of the recording medium. The second conveyance guide has a main body portion which has a projecting portion which projects toward the first conveyance guide most in a recording-medium conveyance path, and a step portion which is formed adjacent to the projecting portion on a downstream side of the projecting portion, an elastic member which projects toward the first conveyance guide beyond a plane passing through a downstream-side end of the projecting portion and a downstream-side end of the step portion, and a film member which covers the main body portion together with the elastic member.

11 Claims, 12 Drawing Sheets

IMAGE FORMING APPARATUS

INCORPORATION BY REFERENCE

This application is based upon and claims the benefit of priority from the corresponding Japanese Patent Applications No. 2018-94309 filed on May 16, 2018 and No. 2018-94310 filed on May 16, 2018, the entire contents of which are incorporated herein by reference.

BACKGROUND

The present disclosure relates to image forming apparatuses such as copiers, printers, facsimile machines, etc., and in particular, relates to a method for stabilizing a recording-medium conveyance state on the upstream side of an image carrier and a transfer member.

In an image forming apparatus using an electrophotography method, a toner image is formed by making toner adhere to an electrostatic latent image formed on an image carrier such as a photosensitive drum or the like, the toner image is transferred onto a sheet as a recording medium, such as a sheet of paper or the like, and then the toner image on the recording medium is fixed by a fixing device (fixing section).

In such an image forming apparatus, units such as a photosensitive drum, a developing device, and the like are densely arranged for compactness, making airtightness high around the photosensitive drum. In the configuration described above, for example, at a time when the leading edge of the sheet enters, from a registration roller pair, into a nip (transfer nip) formed between a photosensitive drum and a transfer roller, or at a time when the rear edge of the sheet leaves the nip of the registration roller pair or an intermediate roller, if the state of sheet conveyance changes (for example, fluttering or abrupt position change of the sheet), the change causes a change in volume of a conveyance space, and airflow is generated by a change in air pressure ascribable to the volume change.

When passing through a gap (development nip) between the photosensitive drum and a developing roller, this airflow scatters toner particles having been caused by a developing electric field to fly from a developing roller to the photosensitive drum. As a result, the scattered toner particles sometimes adhere to the photosensitive drum at wrong positions deviated from their appropriate adhesion positions, generating horizontal stripes in a halftone image or in a solid image.

On the other hand, if the gap is reduced between upper and lower pre-transfer guides arranged on the upstream side of the transfer nip with respect to a sheet conveyance direction to thereby reduce the fluttering of the sheet, it may increase a conveyance load in conveying a hard paper sheet such as a thick paper sheet, to cause transfer defect such as reduction in transfer magnification, transfer misalignment, etc.

As a solution to such inconvenience, there has been proposed a method for reducing defective transfer by smoothly guiding a sheet into the transfer nip both in the case of using a regular paper sheet and in the case of using a thick paper sheet, and there have been known a process cartridge and an image forming apparatus, for example, in which first and second guide members constituted by flexible film members are provided on the upstream side of a transfer position to thereby maintain a regular paper sheet in an appropriate state for entering the photosensitive body on one hand and to reduce the load with respect to a thick paper sheet on the other hand.

There is also known a configuration that includes a flexible guide plate which supports, on one of its surfaces, a sheet conveyed by a sheet feed roller or the like, and guides the sheet toward a photosensitive drum, and a sponge that is provided on the other surface of the guide plate and is softer than the guide plate, such that the sponge is formed to project toward the photosensitive drum beyond the photosensitive-drum side edge of the guide plate, whereby vibration of the guide plate and the fluttering of the rear end of the sheet are reduced, and flapping sound made by the guide plate is also reduced.

SUMMARY

According to an aspect of the present disclosure, an image forming apparatus includes an image carrier, a transfer member, a registration roller pair, and a conveyance guide. The transfer member transfers a toner image formed on the image carrier onto a recording medium. The registration roller pair conveys the recording medium to a transfer nip between the transfer member and the image carrier with a predetermined timing. The conveyance guide includes a first conveyance guide which faces the image-carrier-side surface of the recording medium conveyed from the registration roller pair to the transfer nip and a second conveyance guide which faces the transfer-member-side surface of the recording medium. The second conveyance guide has a main body portion, an elastic member, and a film member. The main body portion has a projecting portion which projects toward the first conveyance guide most in a recording-medium conveyance path from the registration roller pair to the transfer nip, and a step portion which is formed on a downstream side of the projecting portion with respect to a recording-medium conveyance direction so as to be adjacent to the projecting portion. The elastic member projects toward the first conveyance guide beyond a plane passing through a downstream-side end part of the projecting portion and a downstream-side end part of the step portion. The film member covers, over an entire region in a width direction perpendicular to the recording-medium conveyance direction, a surface of the main body portion that faces the first conveyance guide, together with the elastic member.

Still other objects of the present disclosure and specific advantages provided by the present disclosure will become further apparent from the following descriptions of embodiments.

DETAILED DESCRIPTION

Figure 1:
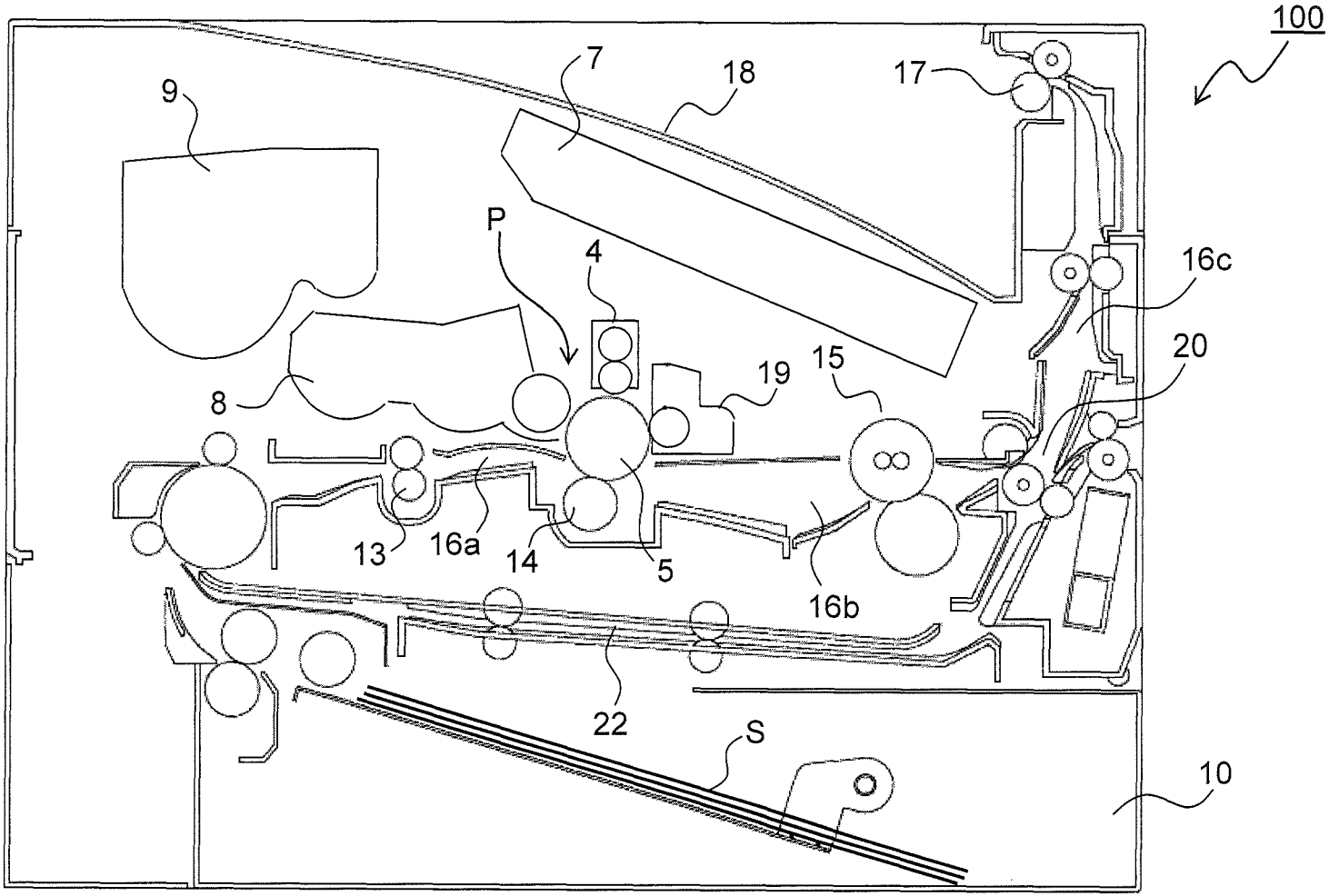
FIG. 1 is a side sectional view illustrating the inner structure of an image forming apparatus according to a first embodiment of the present disclosure.
Figure 2:
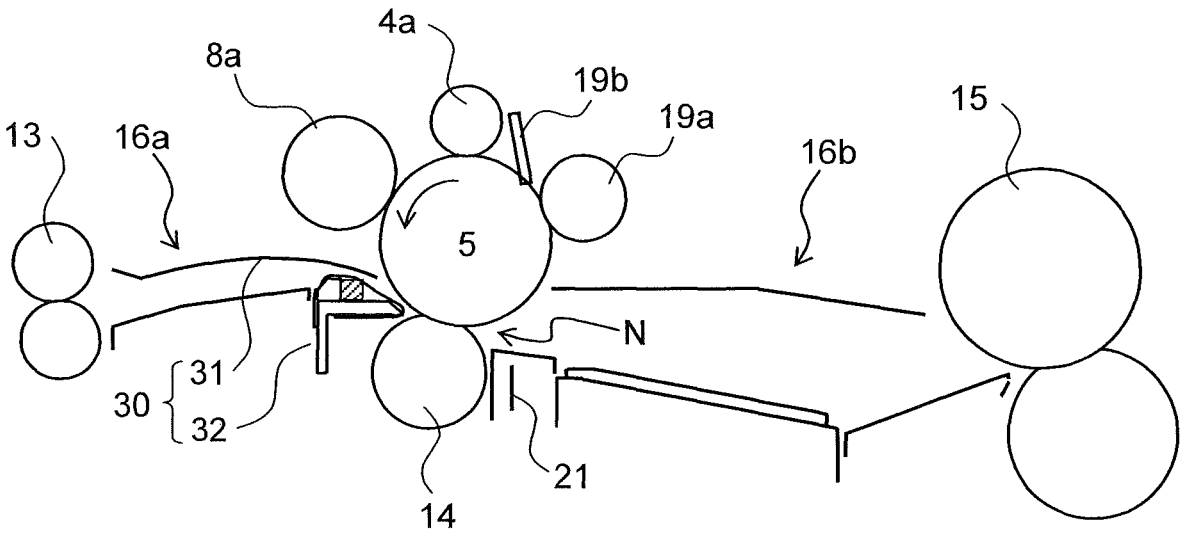
FIG. 2 is a partial enlarged view illustrating a sheet conveyance path from a registration roller pair to a fixing device illustrated in FIG. 1.

Hereinafter, embodiments of the present disclosure will be described with reference to the accompanying drawings. FIG. 1 is a side sectional view illustrating the inner structure of an image forming apparatus 100 according to a first embodiment of the present disclosure. FIG. 2 is a partial enlarged view illustrating a sheet conveyance path from a registration roller pair 13 to a fixing device 15 illustrated in FIG. 1. As illustrated in FIG. 1, inside the image forming apparatus (for example, a monochrome printer) 100, an image forming section P is arranged where a monochrome image is formed through charging, exposing, developing, and transfer steps. In the image forming section P, along a rotation direction of a photosensitive drum 5 (the counterclockwise direction in FIG. 1), there are arranged a charging device 4, an exposure device (a laser scanning unit or the like) 7, a developing device 8, a transfer roller 14, a cleaning device 19, and a destaticizing device (not shown).

The charging device 4 includes a charging roller 4*a* which contacts the photosensitive drum 5 and applies charging bias to the drum surface. The charging roller 4*a* is made of an electrically conductive rubber, and is arranged in contact with the photosensitive drum 5. When the photosensitive drum 5 rotates in the counterclockwise direction in FIG. 2, the charging roller 4*a*, which is in contact with the surface of the photosensitive drum 5, follows to rotate in the clockwise direction in FIG. 2. At this time, a predetermined voltage is applied to the charging roller 4*a*, and thereby, the surface of the photosensitive drum 5 is uniformly charged.

The developing device 8 includes a developing roller 8*a*, by which an electrostatic latent image formed on the photosensitive drum 5 is developed. The developing roller 8*a* is arranged so as to be spaced from the photosensitive drum 5 by a predetermined gap (developing nip), and rotates in the clockwise direction in FIG. 2. Inside the developing device 8, there is stored a one-component developer (hereinafter, simply referred to as toner), which is constituted by a magnetic toner component alone. The toner is replenished to the developing device 8 from a toner container 9.

The transfer roller 14 forms a transfer nip N by being in contact with the photosensitive drum 5, and transfers a toner image formed on the surface of the photosensitive drum 5 onto a sheet S passing through the transfer nip N. The transfer roller 14 has connected thereto a transfer-bias power supply for applying a transfer bias of which the polarity is opposite to the polarity of toner, and a bias control circuit (of which neither is illustrated). Near the transfer roller 14 on its downstream side with respect to a sheet conveyance direction, a destaticizing needle 21 is arranged. The destaticizing needle 21 applies, to the sheet S, a bias (transfer reverse bias) of the same polarity (positive polarity) as the toner and thereby removes residual charge (negative charge) on the sheet S having passed through the transfer nip N, and this facilitates the separation of the sheet S from the photosensitive drum 5.

The transfer roller 14 is disposed so as to be offset to the upstream side (in FIG. 2, left side) of the lower end part of the photosensitive drum 5 with respect to the sheet conveyance direction. With this arrangement, the conveyance direction of the sheet S having passed through the transfer nip N points downward, and consequently the sheet S becomes unlikely to be curled up. This contributes to the preferable destaticization of the sheet S performed by the destaticizing needle 21 after the sheet S passes through the transfer nip N. Furthermore, it is possible to reduce the occurrence of winding of the sheet S around the photosensitive drum 5 when curvature separation of the sheet S from the photosensitive drum 5 is performed.

The cleaning device 19 has a rubbing roller 19*a* and a cleaning blade 19*b*, and removes residual toner on the surface of the photosensitive drum 5, meanwhile polishing the surface of the photosensitive drum 5. The destaticizing device (not shown) which removes residual charge on the surface of photosensitive drum 5 is provided on the downstream side of the cleaning device 19.

On a first sheet conveyance path 16*a*, which is provided between the registration roller pair 13 and the transfer roller 14, a conveyance guide 30 is arranged. The conveyance guide 30 extends along a sheet width direction (direction perpendicular to the surface of the sheet on which FIG. 2 is drawn), and includes an upper conveyance guide 31 which faces an upper surface of the sheet S and a lower conveyance guide 32 which faces a lower surface of the sheet S.

The registration roller pair 13 is arranged below the direction of a tangent of the photosensitive drum 5 on the entry side of the transfer nip N. Consequently, the registration roller pair 13 is out of an attachment/detachment path of a drum unit including the developing device 8, a toner container 9, and the photosensitive drum 5, and this facilitates the maintenance of the developing device 8, the toner container 9, and the photosensitive drum 5.

As for the entry route of the sheet S into the transfer nip N, in view of reducing scattering of toner on the upstream side of the transfer nip N, it is preferable to convey the sheet S along the photosensitive drum 5 before the sheet S comes into contact with the transfer roller 14. To achieve this, the first sheet conveyance path (pre-transfer conveyance path) 16*a* extending from the registration roller pair 13 to the transfer nip N is formed in a reverse-V shape such that it is inclined once upward from the registration roller pair 13 and then downward toward the transfer nip N along the upper conveyance guide 31 and the lower conveyance guide 32.

When an image forming operation is performed, the charging device 4 uniformly charges the photosensitive drum 5 rotating in the counterclockwise direction. Next, a laser beam from the exposure device 7 forms an electrostatic latent image on the photosensitive drum 5. Image data based on which the electrostatic latent image is formed is transmitted from a personal computer (not shown) or the like. Then, the developing device 8 makes a toner adhere to the electrostatic latent image, and thereby a toner image is formed.

Toward the photosensitive drum 5, on which the toner image has been formed in the above manner, the sheet S is conveyed from a sheet feed cassette 10 via the registration roller pair 13 and the first sheet conveyance path 16*a*, and the toner image formed on the surface of the photosensitive drum 5 is transferred onto the sheet S by the transfer roller 14. The sheet S having had the toner image transferred thereon is separated from the photosensitive drum 5 to be conveyed via a second sheet conveyance path 16*b* to the fixing device 15, where the toner image is fixed on the sheet S.

The sheet S having passed through the fixing device 15 is conveyed via a third sheet conveyance path 16*c* to an upper part of the image forming apparatus 100. In a case of forming an image only on one side of the sheet S (in simplex printing), the sheet S is discharged onto a discharge tray 18 via a discharge roller pair 17.

On the other hand, in a case of forming an image on each side of the sheet S (in duplex printing), after the rear end of the sheet S passes through a branching portion 20 arranged in the sheet conveyance path 16, the discharge roller pair 17 is reversely rotated to reverse the conveyance direction. Consequently, the sheet S is directed from the branching portion 20 into a reverse conveyance path 22 to be conveyed, with its printed side turned upside down, back to the registration roller pair 13. Then, the next toner image formed on the photosensitive drum 5 is transferred by the transfer roller 14 onto the side of the sheet S on which no image has been printed yet. After the next toner image is transferred onto the sheet S, the sheet S is conveyed to the fixing device 15 to have the next toner image fixed, and is then discharged via the discharge roller pair 17 onto the discharge tray 18.

Figure 3:
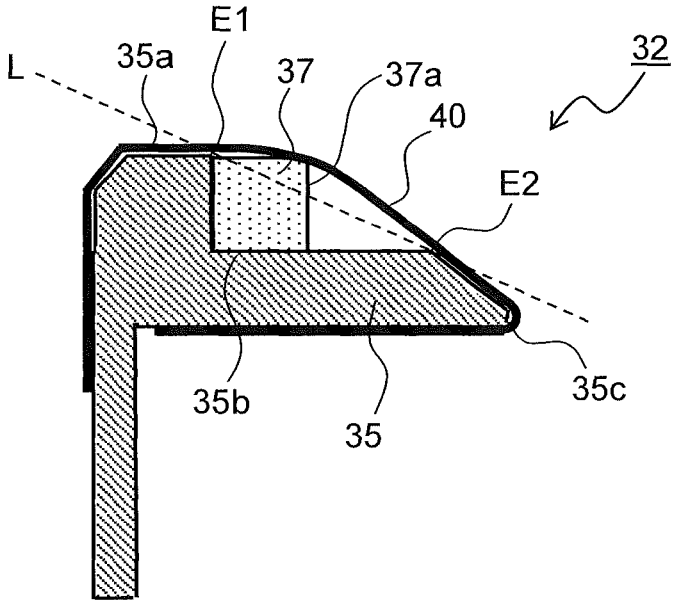
FIG. 3 is a side sectional view, taken along a conveyance direction, of a lower conveyance guide included in a conveyance guide used in the image forming apparatus according to the first embodiment.

FIG. 3 is a side sectional view, taken along the conveyance direction, of the lower conveyance guide 32 constituting the conveyance guide 30 used in the image forming apparatus 100 according to the first embodiment. The lower conveyance guide 32 has a main body portion 35, an elastic member 37, and a film member 40. The main body portion 35 is made of an electrically conductive resin material. The main body portion 35 has a projecting portion 35*a* which projects upward the most in the first sheet conveyance path 16*a* extending from the registration roller pair 13 to the transfer nip N, a step portion 35*b* formed on the downstream side of the projecting portion 35*a* with respect to the sheet conveyance direction so as to be adjacent to the projecting portion 35*a*, and a leading end portion 35*c* which extends on the downstream side of the step portion 35*b* to be close to the transfer nip N (see FIG. 2).

The elastic member 37 is fixed to the step portion 35*b* of the main body portion 35 over the entire region in the sheet width direction (which is a direction perpendicular to the surface of the sheet on which FIG. 3 is drawn and hereinafter will sometimes be be referred to simply as the width direction). In this embodiment, a sponge is used as the elastic member 37. The elastic member 37 is a rectangular parallelepiped (rectangular in section), and is arranged such that an upper corner part (in FIG. 3, a right upper portion) thereof on the downstream side with respect to the sheet conveyance direction projects beyond a plane L passing through a downstream-side edge part E1 of the projecting portion 35*a* and a downstream-side edge part E2 of the step portion 35*b* toward the upper conveyance guide 31.

The film member 40 is wound around and fixed to the lower conveyance guide 32 so as to cover, over the entire region in the sheet width direction, an opposing surface from the projecting portion 35*a* of the main body portion 35 through the elastic member 37 to the leading end portion 35*c*, the opposing surface facing the upper conveyance guide 31. The film member 40 is fixed under such a tension that does not cause elastic deformation of the elastic member 37. Preferable as the material of the film member 40 is a resin film having high wear resistance and preferable slidability. Further, in view of preventing adhesion of toner to the film member 40 due to static charge caused by the rubbing of the sheet S with the film member 40, it is preferable that the film member 40 be electrically conductive. In this embodiment, an electrically conductive ultra-high molecular weight polyethylene sheet is used as the film member 40.

Further, in view of releasing charge collected on the film member 40 due to rubbing with the sheet S, it is preferable that the film member 40 be grounded. The film member 40 may be grounded by directly connecting it to a frame (not shown) of the image forming apparatus 100, or, in a case where the main body portion 35 is electrically conductive, it may be grounded via the main body portion 35. Here, in a case where the resistance of the sheet S is low due to, for example, moisture in the sheet S, the transfer bias escapes to the ground via the sheet S and the lower conveyance guide 32, and thus, in the case of grounding the film member 40, it is preferable to ground it via a resistor (high resistance metal glaze resistor) having a resistance of the order of mega ohms.

Figure 4:
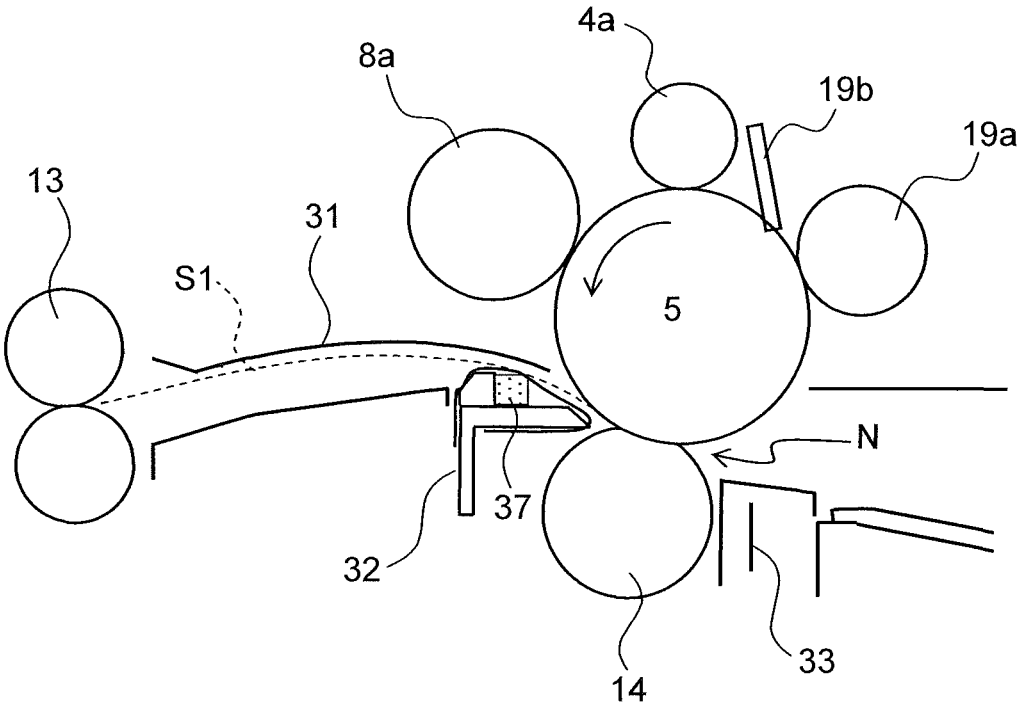
FIG. 4 is a side sectional view illustrating how a sheet is conveyed from the registration roller pair to the transfer nip in the image forming apparatus according to the first embodiment, illustrating a case where the sheet is a regular paper sheet.
Figure 5:
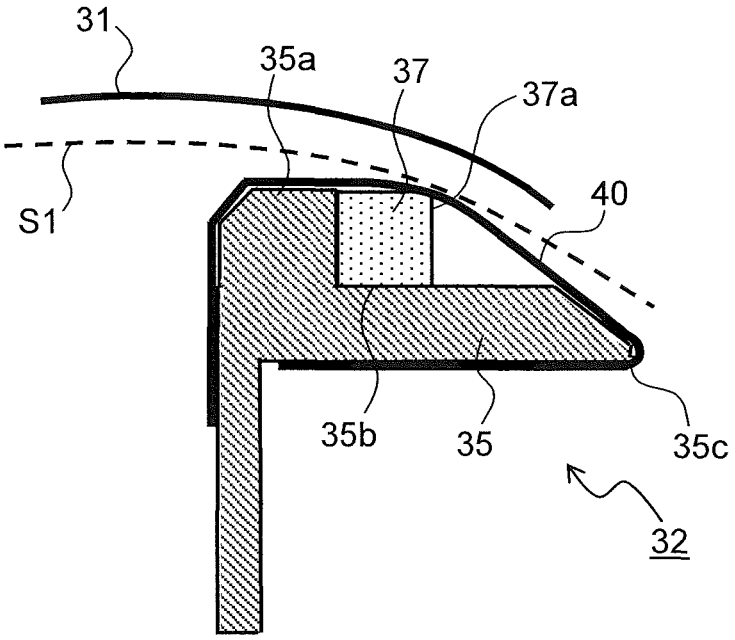
FIG. 5 is an enlarged view of the lower conveyance guide illustrated in FIG. 4.

Next, a description will be given of how the sheet S is conveyed from the registration roller pair 13 to the transfer nip N in the image forming apparatus 100 of this embodiment. FIG. 4 is a side sectional view illustrating how a regular paper sheet S1 is conveyed from the registration roller pair 13 to the transfer nip N, and FIG. 5 is an enlarged view of and around the lower conveyance guide 32 illustrated in FIG. 4. Since the regular paper sheet S1 is flexible, the deformation amount of the elastic member 37 is small when the regular paper sheet S1 is conveyed over it.

As a result, the film member 40 is supported in a convex shape by a ridge line 37*a*, which is formed as a straight line, of the elastic member 37, and thus, as illustrated in FIG. 5, the conveyance course (indicated by a broken line in FIG. 4 and FIG. 5) of the regular paper sheet S1 is near the upper conveyance guide 31 over the entire region in the width direction, the gap between the regular paper sheet S1 and the upper conveyance guide 31 does not become wider, and the fluttering of the regular paper sheet S1 is reduced. Accordingly, toner scattering due to the generation of airflow is reduced at the developing nip.

Figure 6:
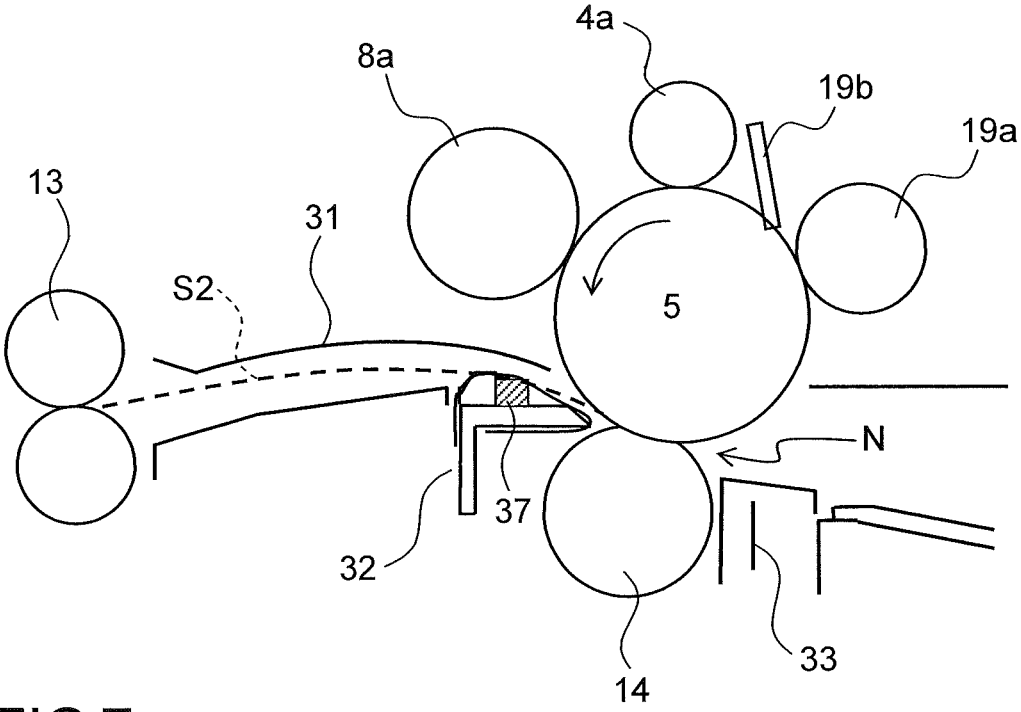
FIG. 6 is a side sectional view illustrating how a sheet is conveyed from the registration roller pair to the transfer nip in the image forming apparatus according to the first embodiment, illustrating a case where the sheet is a thick paper sheet.
Figure 7:
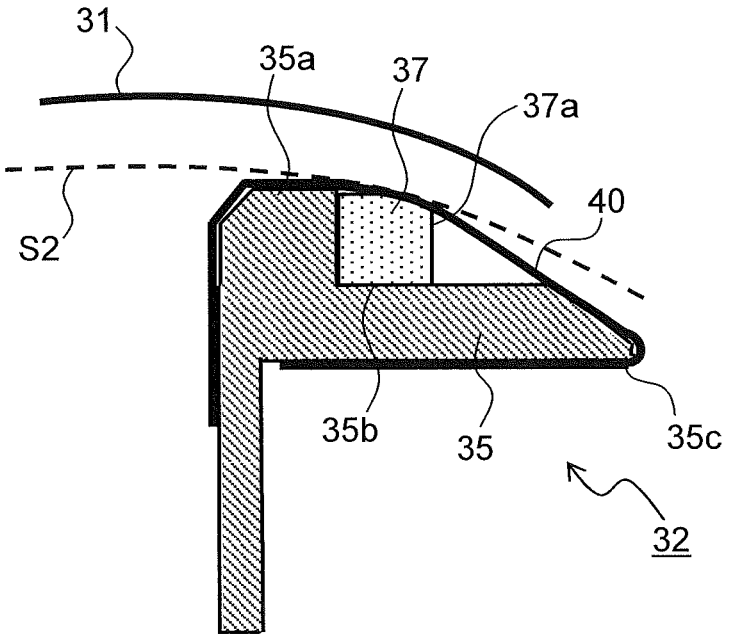
FIG. 7 is an enlarged view of the lower conveyance guide illustrated in FIG. 6.

FIG. 6 is a side sectional view illustrating how a thick paper sheet S2 is conveyed from the registration roller pair 13 to the transfer nip N, and FIG. 7 is an enlarged view of and around the lower conveyance guide 32 illustrated in FIG. 6. Since the thick paper sheet S2 is stiff, it is conveyed to the transfer nip N while pressing and thereby elastically deforming the projecting portion (the ridge line 37*a*) of the elastic member 37. In this way, the friction between the thick paper sheet S2 and the lower conveyance guide 32 is reduced, and accordingly the conveyance load when conveying the thick paper sheet S2 is diminished.

Although, as illustrated in FIG. 7, the conveyance course (indicated by broken lines in FIG. 6 and FIG. 7) of the thick paper sheet S2 is near the lower conveyance guide 32 over the entire region in the width direction, since the lower conveyance guide 32 is provided with the projecting portion 35*a*, the gap between the projecting portion 35*a* and the upper conveyance guide 31 is maintained at a constant width even when the elastic member 37 is elastically deformed. Accordingly, also when conveying the thick paper sheet S2, it is possible to minimize the fluttering width of the thick paper sheet S2, and to reduce the conveyance load.

According to the configuration of this embodiment, the elastic member 37 is arranged so as to project upward beyond the plane L passing through the downstream-side edge part E1 of the projecting portion 35*a* and the downstream-side edge part E2 of the step portion 35*b* of the lower conveyance guide 32 with respect to the sheet conveyance direction, and this makes it possible, in conveying the flexible regular paper sheet S1 as the sheet S, to convey it along a course that is near the upper conveyance guide 31, and thus to reduce the fluttering of the rear end of the sheet S. On the other hand, in conveying the stiff thick paper sheet S2 as the sheet S, the elastic member 37 is elastically deformed, and thereby the conveyance load is diminished. Further, since the projecting portion 35*a* maintains a constant gap between the lower conveyance guide 32 and the upper conveyance guide 31, it is also possible to minimize the fluttering of the rear end of the thick paper sheet S2 when it is conveyed.

Accordingly, the fluttering of the rear end of the sheet S is reduced regardless of how stiff the sheet S is, and thus it is possible to reduce toner scattering caused at the developing nip due to the generation of airflow. Furthermore, it is also possible to alleviate the reduction of transfer magnification and to reduce transfer misalignment due to an increase of the conveyance load with respect to the sheet S.

In the image forming apparatus 100 of this embodiment, the first sheet conveyance path 16*a* from the registration roller pair 13 to the transfer nip N is formed in a reverse-V shape such that it is first inclined once upward from the registration roller pair 13 to be then inclined downward toward the transfer nip N. In this case, the conveyance load tends to be large when a stiff sheet S such as the thick paper sheet S2 is conveyed, and thus it is particularly preferable to use the lower conveyance guide 32 of this embodiment.

Figure 8:
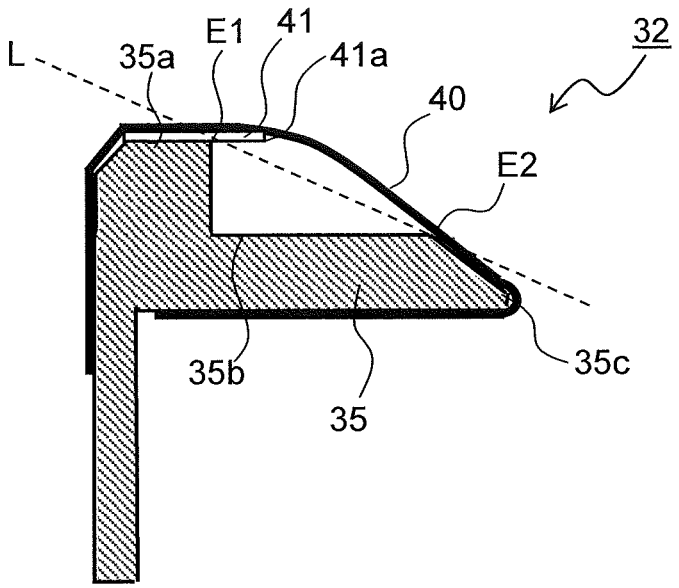
FIG. 8 is a side sectional view, taken along the conveyance direction, of a lower conveyance guide used in an image forming apparatus according to a second embodiment of the present disclosure.

FIG. 8 is a side sectional view, taken along the conveyance direction, of a lower conveyance guide 32 used in an image forming apparatus 100 according to a second embodiment of the present disclosure. In the lower conveyance guide 32 illustrated in FIG. 8, an elastic sheet 41 is provided instead of the elastic member 37. The configurations of the other portions of the lower conveyance guide 32 are substantially similar to those in the first embodiment.

The elastic sheet 41 has one of opposite end parts thereof fixed to a projecting portion 35*a*, and the other one of the opposite end parts thereof projecting from the projecting portion 35*a* toward the downstream side in the sheet conveyance direction over a step portion 35*b*. The elastic sheet 41 is arranged such that a ridge line 41*a* thereof on the downstream side (in FIG. 6, the right end part) with respect to the sheet conveyance direction projects beyond a plane L passing through a downstream-side edge part E1 of the projecting portion 35*a* and a downstream-side edge part E2 of the step portion 35*b* toward an upper conveyance guide 31. As a material of the elastic sheet 41, a polyethylene terephthalate (PET) sheet is used.

In a case where the regular paper sheet S1 is conveyed by using the lower conveyance guide 32 having the configuration of this embodiment, since the regular paper sheet S1 is flexible, the deformation amount of the elastic sheet 41 is small. As a result, the elastic sheet 41 maintains its projecting state as illustrated in FIG. 8, and the film member 40 is supported in a convex shape by the ridge line 41*a* of the elastic sheet 41 formed as a straight line, and thus, the sheet conveyance course is, like in FIG. 4, a course along the film member 40 supported by the elastic sheet 41. Accordingly, the gap between the regular paper sheet S1 and the upper conveyance guide 31 does not become wider and the fluttering of the rear end of the regular paper sheet S1 is reduced, as a result of which toner scattering caused at the developing nip due to the generation of airflow is reduced.

Figure 9:
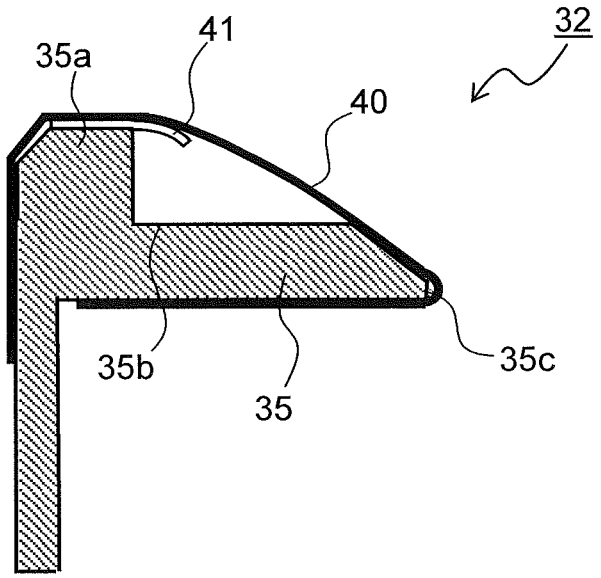
FIG. 9 is a side sectional view, taken along the conveyance direction, of the lower conveyance guide with an elastic sheet bent when a thick paper sheet is conveyed in the image forming apparatus according to the second embodiment.

FIG. 9 is a side sectional view of the lower conveyance guide 32, illustrating a state where the thick paper sheet S2 is conveyed and thereby the elastic sheet 41 is bent. As illustrated in FIG. 9, in the case where the stiff thick paper sheet S2 is conveyed, the thick paper sheet S2 presses and elastically deforms the projecting portion (the ridge line 41*a*) of the elastic sheet 41 while being conveyed to the transfer nip N. Thereby, the conveyance load when conveying the thick paper sheet S2 is diminished. Further, the sheet conveyance course is, as in FIG. 6, a course along the elastically deformed elastic sheet 41, but since the lower conveyance guide 32 is provided with the projecting portion 35*a*, the gap between the projecting portion 35*a* and the upper conveyance guide 31 is maintained to a constant width even when the elastic sheet 41 is elastically deformed.

Accordingly, also when conveying the thick paper sheet S2, it is possible to minimize the fluttering of its rear end and to reduce the conveyance load.

Accordingly, as in the first embodiment, it is possible to reduce the fluttering of the rear end of the sheet S to be conveyed, regardless of how stiff the sheet S is, and thus it is possible to reduce toner scattering caused at the developing nip due to the generation of airflow. Furthermore, it is also possible to alleviate the reduction of transfer magnification and to reduce transfer misalignment, both due to an increase of the conveyance load with respect to the sheet S.

Figure 10:
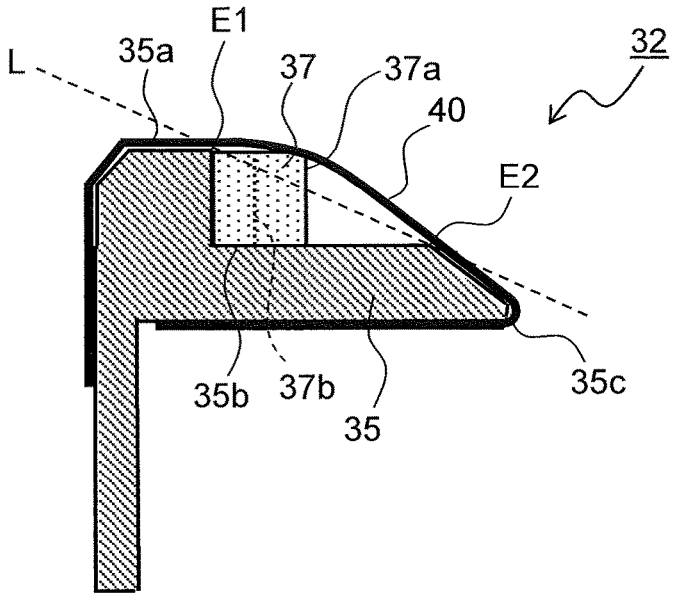
FIG. 10 is a side sectional view, taken along the conveyance direction, of a lower conveyance guide included in a conveyance guide used in an image forming apparatus according to a third embodiment of the present disclosure.

FIG. 10 is a side sectional view, taken along the conveyance direction, of a lower conveyance guide 32 constituting a conveyance guide 30 used in an image forming apparatus 100 according to a third embodiment of the present disclosure. The lower conveyance guide 32 has a main body portion 35, an elastic member 37, and a film member 40. The main body portion 35 is made of an electrically conductive resin material. The main body portion 35 has a projecting portion 35*a* which projects upward the most in the first sheet conveyance path 16*a*, which is from the registration roller pair 13 to the transfer nip N, a step portion 35*b* formed on the downstream side of the projecting portion 35*a* with respect to the sheet conveyance direction so as to be adjacent to the projecting portion 35*a*, and a leading end portion 35*c* which extends on the downstream side of the step portion 35*b* to be close to the transfer nip N (see FIG. 2).

The elastic member 37 is fixed to the step portion 35*b* of the main body portion 35 over the entire region in the sheet width direction (which is a direction perpendicular to the surface of the sheet on which FIG. 10 is drawn). In this embodiment, a sponge is used as the elastic member 37. The elastic member 37 is a rectangular parallelepiped (rectangular in section), and is arranged such that an upper corner part (in FIG. 10, a right upper part) thereof on the downstream side with respect to the sheet conveyance direction projects beyond a plane L passing through a downstream-side edge part E1 of the projecting portion 35*a* and a downstream-side edge part E2 of the step portion 35*b* toward the upper conveyance guide 31.

The film member 40 is wound around and fixed to the lower conveyance guide 32 so as to cover, over the entire region in the sheet width direction, an opposing surface from the projecting portion 35*a* through the elastic member 37 to the leading end portion 35*c*, the opposing surface facing the upper conveyance guide 31. The film member 40 is fixed under such a tension that does not cause elastic deformation of the elastic member 37. The same material and the same grounding method as mentioned in the first embodiment are preferable also as those of the film member 40.

Figure 11:
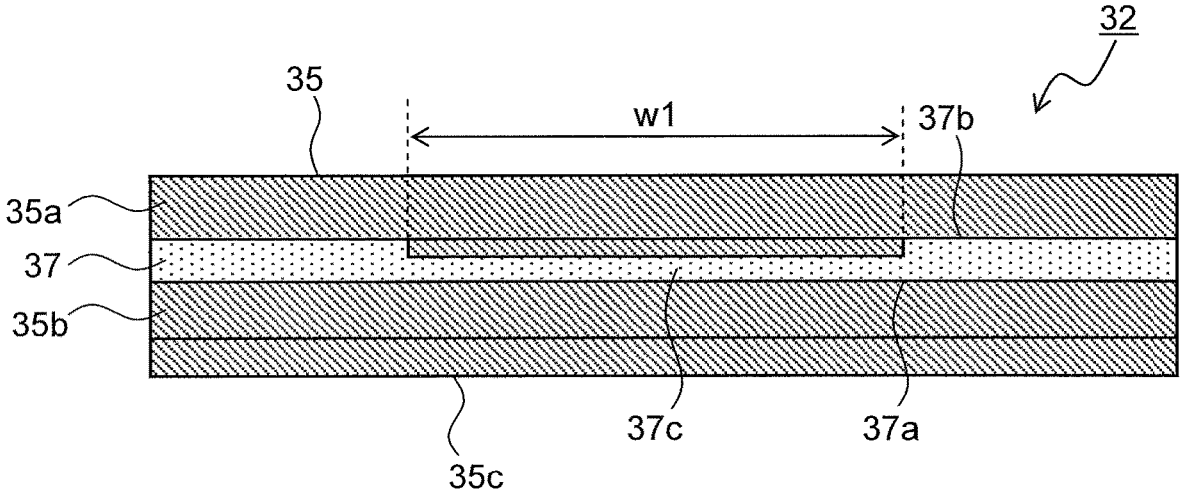
FIG. 11 is a plan view, as seen from above, of the lower conveyance guide illustrated in FIG. 10.

FIG. 11 is a plan view, as seen from above, of the lower conveyance guide 32 illustrated in FIG. 10. Here, for convenience of description, FIG. 11 illustrates a state with the film member 40 removed. As illustrated in FIG. 11, a ridge line 37*a* of the elastic member 37 on the downstream side (in FIG. 11, the lower side) with respect to the sheet conveyance direction is a straight line. On the other hand, in a ridge line 37*b* on the upstream side (in FIG. 11, upper side) with respect to the sheet conveyance direction, there is formed a recessed portion 37*c* by recessing a center part of the ridge line 37*b* in the sheet width direction (in FIG. 4, a left-right direction) to the downstream side. That is, the thickness of the elastic member 37 is smaller at its width-direction center part than at another part thereof.

Figure 12:
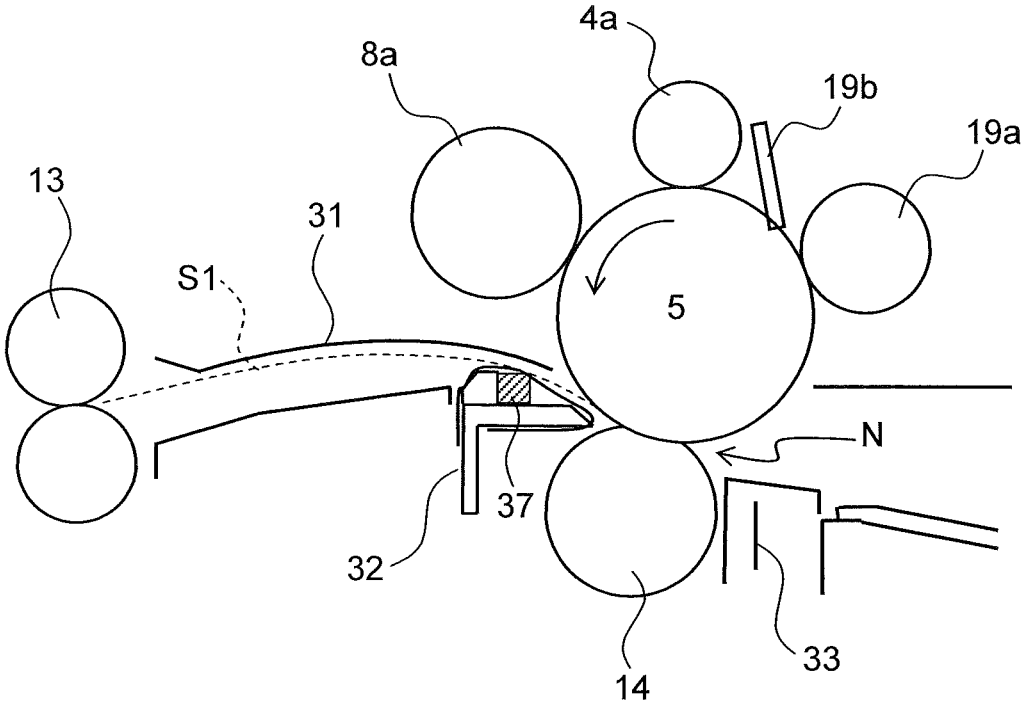
FIG. 12 is a side sectional view illustrating how a regular paper sheet is conveyed from the registration roller pair to the transfer nip in the image forming apparatus according to the third embodiment.
Figure 13:
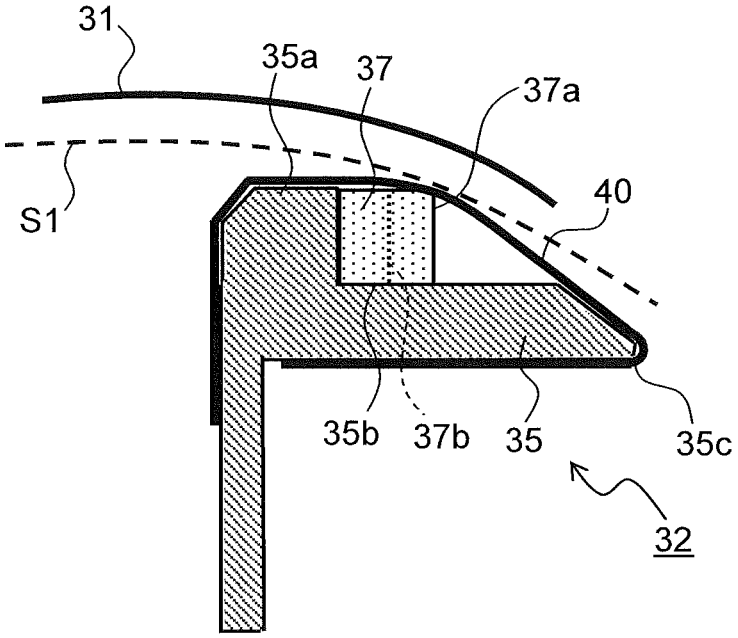
FIG. 13 is an enlarged view of and around the lower conveyance guide illustrated in FIG. 12.

Next, a description will be given of how the sheet S is conveyed from the registration roller pair 13 to the transfer nip N in the image forming apparatus 100 of this embodiment. FIG. 12 is a side sectional view illustrating how the regular paper sheet S1 is conveyed from the registration roller pair 13 to the transfer nip N, and FIG. 13 is an enlarged view of and around the lower conveyance guide 32 illustrated in FIG. 12. Since the regular paper sheet S1 is flexible, the deformation amount of the elastic member 37 is small when the regular paper sheet S1 is conveyed.

As a result, the film member 40 is supported in a convex shape by a ridge line 37*a*, which is a straight line, of the elastic member 37, and thus, as illustrated in FIG. 13, the conveyance course (indicated by broken lines in FIG. 12 and FIG. 13) of the regular paper sheet S1 is near the upper conveyance guide 31 over the entire region in the width direction, the gap between the regular paper sheet S1 and the upper conveyance guide 31 does not become wider, and the fluttering of the regular paper sheet S1 is reduced. Accordingly, toner scattering caused at the developing nip due to the generation of airflow is reduced.

Figure 14:
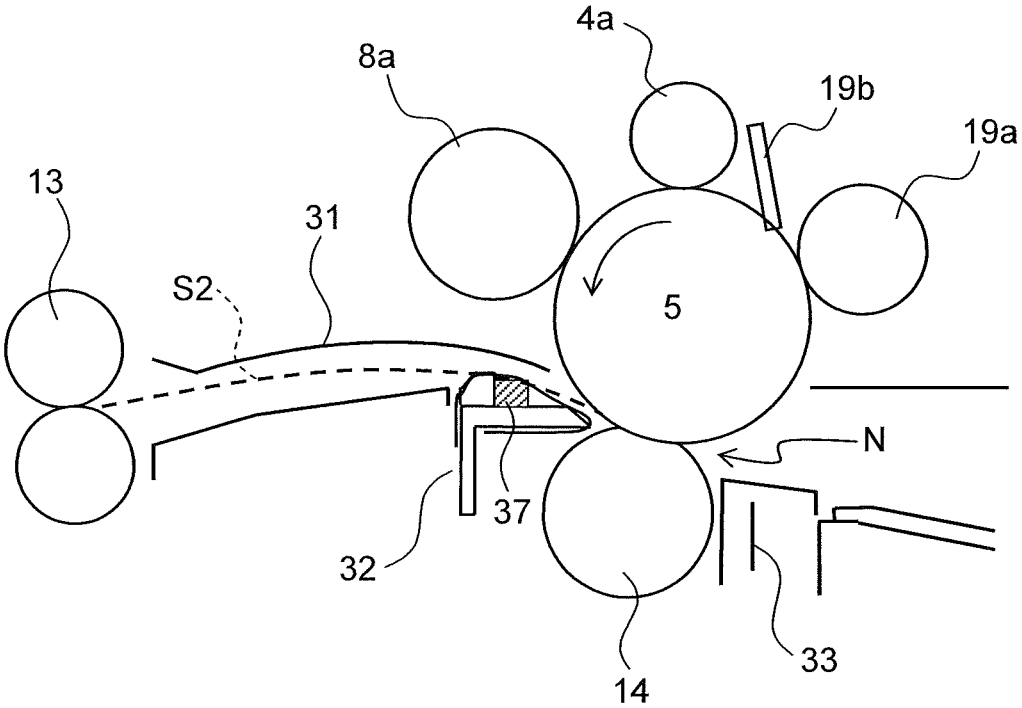
FIG. 14 is a side sectional view illustrating how a thick paper sheet is conveyed from the registration roller pair to the transfer nip in the image forming apparatus according to the third embodiment.
Figure 15:
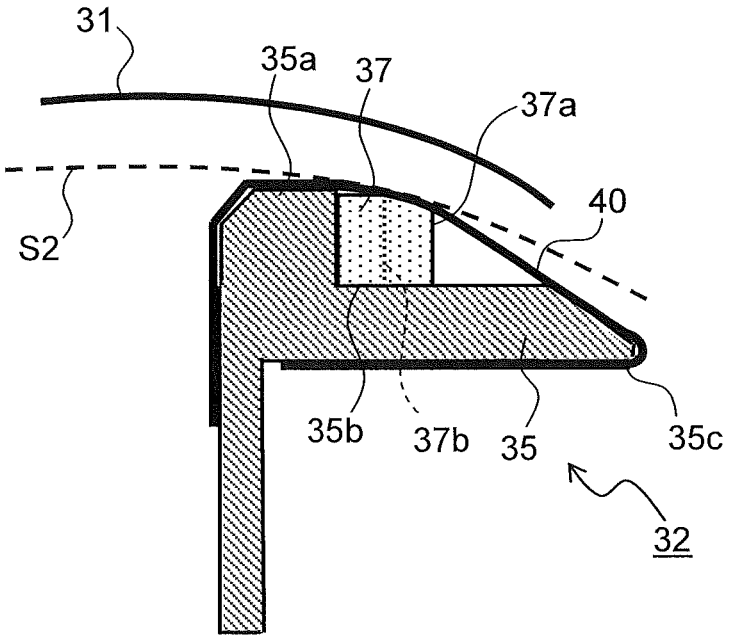
FIG. 15 is an enlarged view of and around the lower conveyance guide illustrated in FIG. 14.

FIG. 14 is a side sectional view illustrating how the thick paper sheet S2 is conveyed from the registration roller pair 13 to the transfer nip N, and FIG. 15 is an enlarged view of and around the lower conveyance guide 32 illustrated in FIG. 14. Since the thick paper sheet S2 is stiff, it is conveyed to the transfer nip N while pressing and thereby elastically deforming the projecting portion (the ridge line 37*a*) of the elastic member 37. In this way, the friction between the thick paper sheet S2 and the lower conveyance guide 32 is reduced, and accordingly the conveyance load when conveying the thick paper sheet S2 is diminished.

Although, as illustrated in FIG. 14, the conveyance course (indicated by broken lines in FIG. 14 and FIG. 15) of the thick paper sheet S2 is a course that is near the lower conveyance guide 32 over the entire region in the width direction, since the lower conveyance guide 32 is provided with the projecting portion 35*a*, the gap between the projecting portion 35*a* and the upper conveyance guide 31 is maintained at a constant width even when the elastic member 37 is elastically deformed. Accordingly, it is also possible, also when conveying the thick paper sheet S2, to minimize the fluttering width of the thick paper sheet S2, and to reduce the conveyance load.

As mentioned previously, the conveyance power of the transfer roller 14 is weaker at its center part than at its opposite end parts in the longitudinal direction, and thus, in a case where a thick paper sheet having a small width-direction dimension, such as a postcard, is conveyed, the conveyance speed tends to be low under the influence of the conveyance load due to the lower conveyance guide 32. As a result, the reduction of transfer magnification and transfer misalignment are more likely to occur than in the case of a large width-direction dimension. To cope with this, in this embodiment, the recessed portion 37*c* is provided at the width-direction center part of the elastic member 37, over which the sheet S having a small dimension in the width direction passes; this makes it possible to reduce the conveyance load with respect to a thick paper sheet having a small width-direction dimension.

Figure 16:
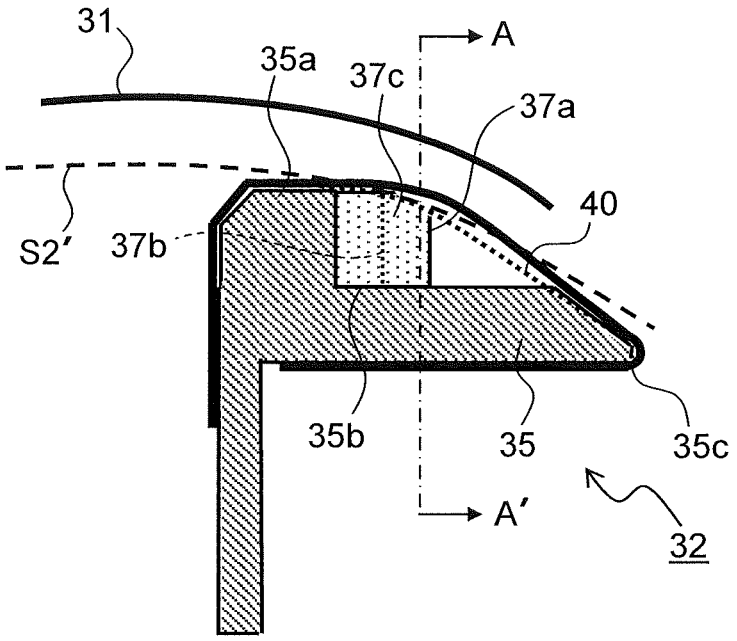
FIG. 16 is a side sectional view, taken along the conveyance direction, of the lower conveyance guide over which a small-sized thick paper sheet is conveyed bending a film member at a width-direction center part thereof in the image forming apparatus according to the third embodiment.
Figure 17:
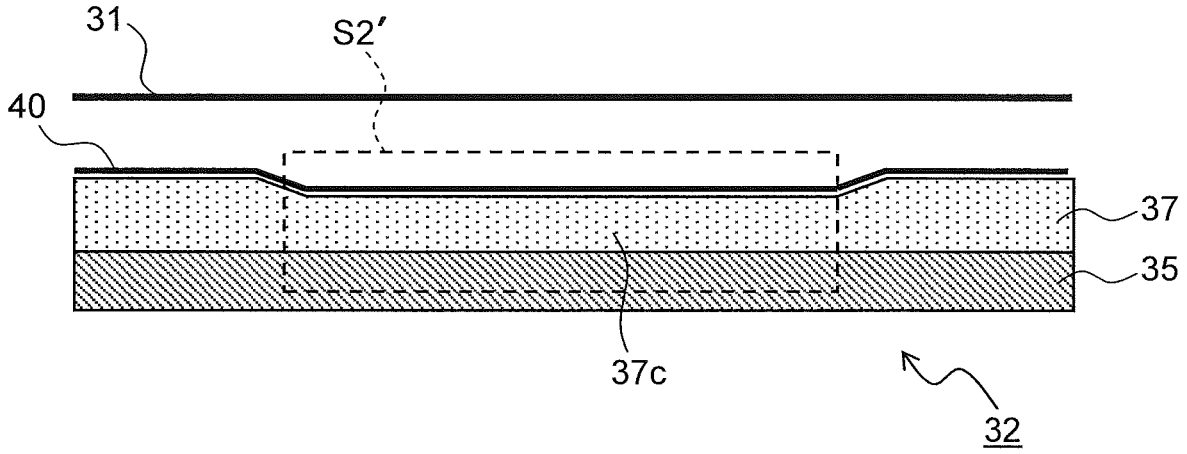
FIG. 17 is a side sectional view, taken along a sheet width direction, of the lower conveyance guide over which a small-sized thick paper sheet is conveyed bending the film member at the width-direction center part thereof in the image forming apparatus according to the third embodiment.

FIG. 16 is a side sectional view of the lower conveyance guide 32 taken along the conveyance direction when a small-sized thick paper sheet S2' is conveyed and the film member 40 is bent at a width-direction center part thereof, and FIG. 17 is a side sectional view of the lower conveyance guide 32 taken along the sheet width direction (a sectional view taken along line AA' of FIG. 16) when the small-sized thick paper sheet S2' is conveyed and the film member 40 is bent at the width-direction center part thereof. When the small-sized thick paper sheet S2' is conveyed, it is conveyed while pressing the width-direction center part of the elastic member 37 and thereby elastically deforming the elastic member 37. Here, since the recessed portion 37*c* is formed in the width-direction center part of the elastic member 37, the elastic member 37 is easier to be elastically deformed at its width-direction center part than at another part thereof.

As a result, as indicated by a dotted line in FIG. 16 and as illustrated in FIG. 17, the film member 40 is bent in a downward direction only at the width-direction center part thereof, and the conveyance course (indicated by a broken like in FIG. 16) of the thick paper sheet S2' is a course that is near the lower conveyance guide 32. Thereby, it is possible to effectively reduce the conveyance load with respect to the thick paper sheet S2'.

According to the configuration of this embodiment, the elastic member 37 is arranged so as to project upward beyond the plane L passing through the downstream-side edge part E1 of the projecting portion 35*a* and the downstream-side edge part E2 of the step portion 35*b* of the lower conveyance guide 32 with respect to the sheet conveyance direction, and this makes it possible, in conveying a flexible regular paper sheet S1, to convey the sheet S along the upper conveyance guide 31, and thus to reduce the fluttering of the rear end of the sheet S. On the other hand, in conveying a stiff thick paper sheet S2, the elastic member 37 is elastically deformed and thereby the conveyance load is reduced. Furthermore, the projecting portion 35*a* helps maintain a constant gap between the lower conveyance guide 32 and the upper conveyance guide 31, and this makes it possible to minimize the fluttering of the rear end of the thick paper sheet S2 when it is conveyed.

Accordingly, the fluttering of the rear end of the sheet S is reduced regardless of how stiff the sheet S is, and thus it is possible to reduce the toner scattering caused at the developing nip due to the generation of airflow. Furthermore, it is also possible to alleviate the reduction of transfer magnification and to reduce transfer misalignment due to an increase of the conveyance load with respect to the sheet S.

Further, the provision of the recessed portion 37*c* in the width-direction center part of the elastic member 37 makes it possible to elastically deform the elastic member 37 sufficiently also in the case of conveying the small-sized thick paper sheet S2'. Accordingly, it is possible to reduce the conveyance load regardless of the size of a thick paper sheet conveyed, and thus to effectively alleviate the reduction of transfer magnification and to reduce transfer misalignment. On the other hand, in the case of conveying the regular paper sheet S1, the width-direction center part of the film member 40 is supported by the straight ridge line 37*a* of the elastic member 37 and is not bent at all, and thus it is possible to convey the regular paper sheet S1 along a course that is near the upper conveyance guide 31 over the entire region in the width direction.

In view of sufficiently deforming the elastic member 37 when a sheet S having the smallest width usable in the image forming apparatus 100 is conveyed, it is preferable that a formation width w1 (see FIG. 11) of the recessed portion 37*c* in the sheet width direction be equal to or more than the sheet width of the sheet S having the smallest width. The depth (the sheet-conveyance-direction dimension) of the recessed portion 37*c* is appropriately settable in accordance with the stiffness (basis weight) of the thick paper sheet S2' to be conveyed.

In the image forming apparatus 100 of this embodiment, the first sheet conveyance path 16*a* from the registration roller pair 13 to the transfer nip N is formed in a reverse-V shape such that it is inclined once upward from the registration roller pair 13 to be then inclined downward toward the transfer nip N. In this case, since the conveyance load is large when a stiff sheet S such as the thick paper sheet S2 or S2' is conveyed, it is particularly preferable to use the lower conveyance guide 32 of this embodiment.

Figure 18:
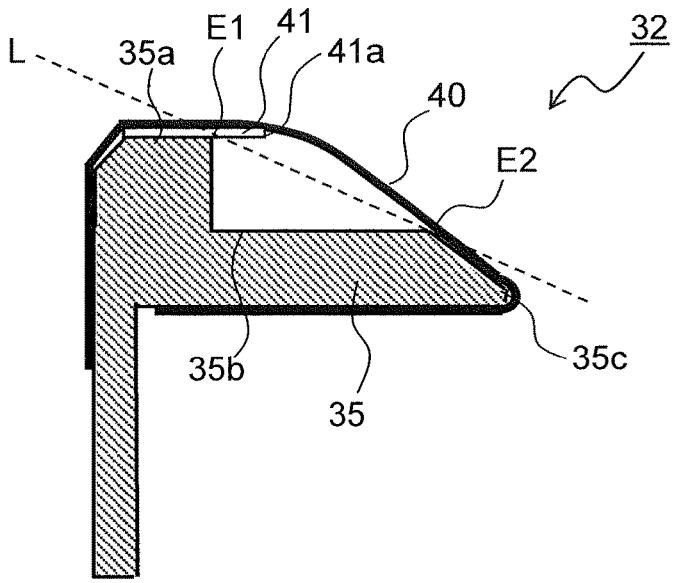
FIG. 18 is a side sectional view, taken along the conveyance direction, of a lower conveyance guide used in an image forming apparatus according to a fourth embodiment of the present disclosure.

FIG. 18 is a side sectional view, taken along the conveyance direction, of a lower conveyance guide 32 used in an image forming apparatus 100 according to a fourth embodiment of the present disclosure. In the lower conveyance guide 32 illustrated in FIG. 18, an elastic sheet 41 is provided instead of the elastic member 37. The configurations of the other portions of the lower conveyance guide 32 are substantially similar to those in the third embodiment.

The elastic sheet 41 has one of opposite end parts thereof fixed to a projecting portion 35*a*, and the other one of the opposite end parts thereof projecting from the projecting portion 35*a* toward the downstream side in the sheet conveyance direction over a step portion 35*b*. The elastic sheet 41 is arranged such that a ridge line 41*a* thereof on the downstream side (in FIG. 18, the right end part) with respect to the sheet conveyance direction projects beyond a plane L passing through a downstream-side edge part E1 of the projecting portion 35*a* and a downstream-side edge part E2 of the step portion 35*b* toward an upper conveyance guide 31. As the elastic sheet 41, a polyethylene terephthalate (PET) sheet is used.

Figure 19:
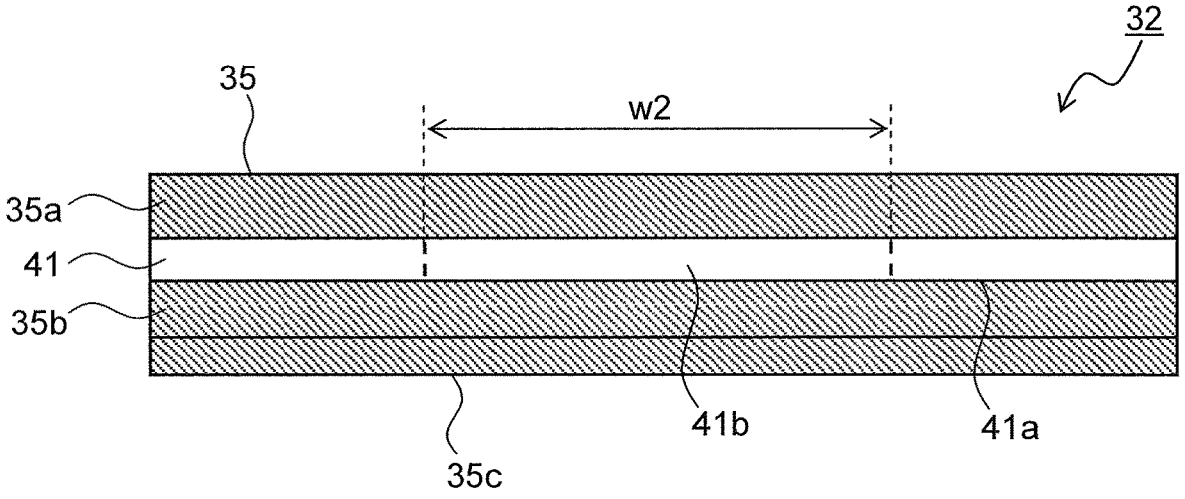
FIG. 19 is a plan view, as seen from above, of the lower conveyance guide illustrated in FIG. 18.

FIG. 19 is a plan view, as seen from above, of the lower conveyance guide 32 illustrated in FIG. 18. Here, for the convenience of description, FIG. 19 illustrates a state with the film member 40 removed. As illustrated in FIG. 19, of the elastic sheet 41, a ridge line 41*a* on the downstream side (in FIG. 19, lower side) with respect to the sheet conveyance direction is a straight line. Further, in a center part of the elastic sheet 41 in the sheet width direction, a thin-walled portion 41*b* is formed. In the thin-walled portion 41*b*, the thickness and the elasticity modulus (Young's modulus) of a polyethylene-terephthalate sheet constituting the elastic sheet 41 is thinner and smaller, respectively, than in another part of the elastic sheet 41. In this embodiment, as illustrated in FIG. 22, which will be referred to later, the thin-walled portion 41*b* is formed by forming opposite end parts of the elastic sheet 41 with a plurality of (two) sheets stacked on one another and forming the center part with a single sheet.

In the case of conveying the regular paper sheet S1 by using the lower conveyance guide 32 having the configuration of this embodiment, since the regular paper sheet S1 is flexible, the deformation amount of the elastic sheet 41 is small. As a result, the elastic sheet 41 maintains its projecting state as illustrated in FIG. 18, and the film member 40 is supported in a convex shape by the ridge line 41*a* of the elastic sheet 41, and thus, as in FIG. 13, the sheet conveyance course is a course along the film member 40 supported by the elastic sheet 41. Accordingly, the gap between the regular paper sheet S1 and the upper conveyance guide 31 does not become wider and the fluttering of the rear end of the regular paper sheet S1 is reduced, as a result of which toner scattering caused at the developing nip due to the generation of airflow is reduced.

Figure 20:
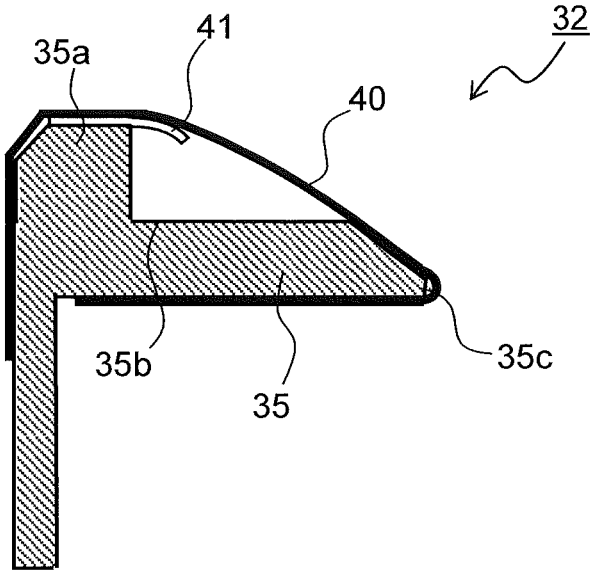
FIG. 20 is a side sectional view, taken along the conveyance direction, of the lower conveyance guide over which a thick paper sheet is conveyed bending an elastic sheet in the image forming apparatus according to the fourth embodiment.

FIG. 20 is a side sectional view of the lower conveyance guide 32 taken along the conveyance direction, illustrating a state where the thick paper sheet S2 is conveyed and the elastic sheet 41 is bent. As illustrated in FIG. 20, in the case of conveying the stiff thick paper sheet S2, the thick paper sheet S2 presses and elastically deforms the projecting portion (the ridge line 41*a*) of the elastic sheet 41 while being conveyed to the transfer nip N. Thereby, the conveyance load when conveying the thick paper sheet S2 is diminished. Although the sheet conveyance course is, as in FIG. 15, a course along the elastically deformed elastic sheet 41, since the lower conveyance guide 32 is provided with the projecting portion 35*a*, the gap between the projecting portion 35*a* and the upper conveyance guide 31 is maintained to a constant width even when the elastic sheet 41 is elastically deformed. Accordingly, also when conveying the thick paper sheet S2, it is possible to minimize the fluttering of the rear end of the thick paper sheet S2 and to reduce the conveyance load.

Figure 21:
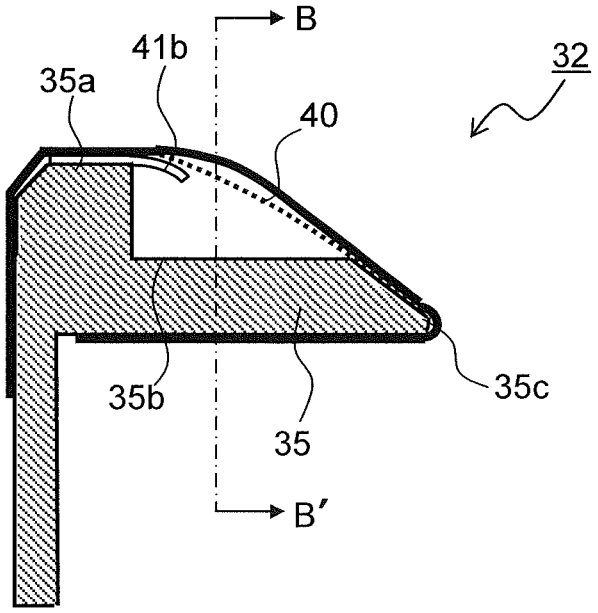
FIG. 21 is a side sectional view, taken along the conveyance direction, of the lower conveyance guide over which a small-sized thick paper sheet is conveyed bending a film member at a width-direction center part thereof in the image forming apparatus according to the fourth embodiment.
Figure 22:
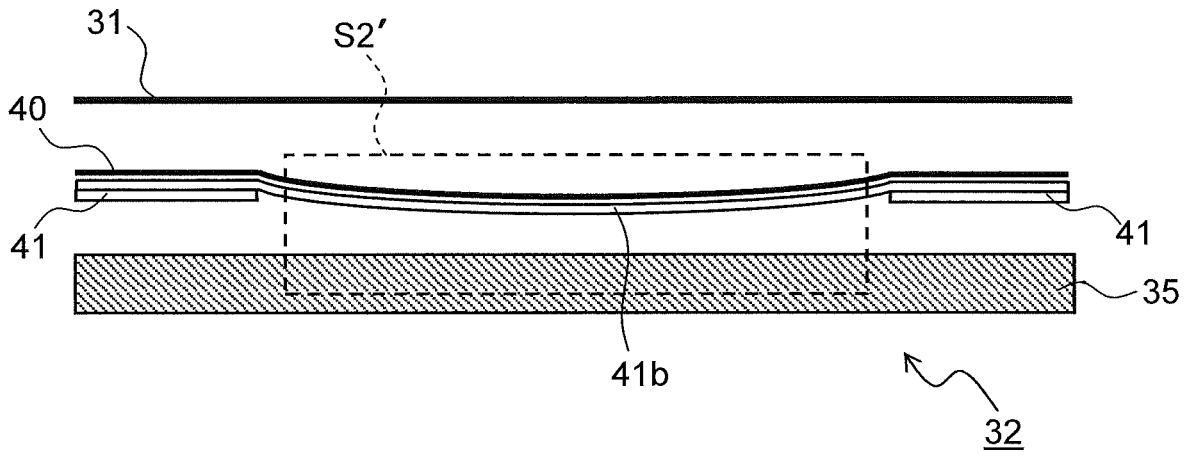
FIG. 22 is a side sectional view, taken along a sheet width direction, of the lower conveyance guide over which a small-sized thick paper sheet is conveyed bending the film member at the width-direction center part thereof in the image forming apparatus according to the fourth embodiment.

FIG. 21 is a side sectional view of the lower conveyance guide 32 taken along the conveyance direction, when a small-sized thick paper sheet S2' is conveyed and thereby the film member 40 is bent at a width-direction center part thereof, and FIG. 22 is a side sectional view of the lower conveyance guide 32 taken along the sheet width direction (a sectional view taken along line BB" of FIG. 21), when the small-sized thick paper sheet S2' is conveyed and thereby the film member 40 is bent at the width-direction center part thereof. When the small-sized thick paper sheet S2' is conveyed, it is conveyed while pressing and thereby elastically deforming the thin-walled portion 41*b*, which is provided at the width-direction center part of the elastic sheet 41. Since the thin-walled portion 41*b* is easier to be elastically deformed than another part of the elastic sheet 41, as indicated by the broken line in FIG. 21 and as illustrated in FIG. 22, in the film member 40, only its width-direction center part is bent downward, and the thick paper sheet S2' is conveyed along a conveyance course that is near the lower conveyance guide 32. Thereby, it is possible to effectively reduce the conveyance load with respect to the thick paper sheet S2'.

According to the configuration of this embodiment, as in the third embodiment, it is possible to reduce the fluttering of the rear end of the sheet S regardless of how stiff the sheet S to be conveyed is, and thus it is possible to reduce toner scattering caused at the developing nip due to the generation of airflow. Furthermore, it is also possible to alleviate the reduction of transfer magnification and to reduce transfer misalignment due to an increase of the conveyance load with respect to the sheet S.

The provision of the thin-walled portion 41*b* in the width-direction center part of the elastic sheet 41 makes it possible to elastically deform the elastic sheet 41 sufficiently also when conveying the thick paper sheet S2' having a small width-direction dimension. Accordingly, it is possible to reduce the conveyance load regardless of the size of a thick paper sheet conveyed, and thus to effectively alleviate the reduction of transfer magnification and to reduce transfer misalignment. On the other hand, in the case of conveying the regular paper sheet S1, the width-direction center part of the film member 40 is supported by the straight ridge line 41*a* of the elastic sheet 41 and is not bent at all, and thus it is possible to convey the regular paper sheet S1 along a course that is near the upper conveyance guide 31 over the entire region in the width direction.

For sufficient deformation of the elastic sheet 41 when the sheet S having the smallest width usable in the image forming apparatus 100 is conveyed, it is preferable that a formation width w2 (see FIG. 19) of the thin-walled portion 41*b* in the sheet width direction be equal to or more than the sheet width of the sheet S having the smallest width. The thickness of the thin-walled portion 41*b* is appropriately settable in accordance with the stiffness (basis weight) of the thick paper sheet S2' to be conveyed.

In this embodiment, the thin-walled portion 41*b* is formed by reducing the number of sheets constituting the elastic sheet 41, and thereby the elasticity modulus of the width-direction center part of the elastic sheet 41 is reduced, but this is not meant as a limitation and the elasticity modulus can be reduced in another way. For example, the elastic sheet 41 may be divided into three regions of a center region and two end regions in the width direction such that the center region in the width direction is formed of a material having a lower elasticity modulus (Young's modulus) than the materials of the other regions. Specifically, a configuration is possible in which the two end regions of the elastic sheet 41 is formed of a stainless steel sheet, and the center region is formed of a polyethylene terephthalate sheet.

The third and fourth embodiments described above have dealt with what is called a central reference feeding system, in which the sheet S is always conveyed through the center of the sheet conveyance path in the width direction, but the present disclosure is applicable also to what is called a one-sided reference feeding system, in which the sheet S is conveyed along one edge of the sheet conveyance path in the width direction. In that case, since a small-sized sheet S is conveyed along one edge of the lower conveyance guide 32 in the width direction, it is advisable that the recessed portion 37*c* and the thin-walled portion 41*b* be formed in the elastic member 37 and the elastic sheet 41, respectively, at parts thereof over which the sheet S passes.

It is to be understood that the present disclosure may be practiced in any other manner than specifically described above as embodiments, and various modifications are possible within the scope of the invention. For example, the gap between the projecting portion 35*a* and the upper conveyance guide 31, the projection amounts of the elastic member 37 and the elastic sheet 41, the thickness of the elastic sheet 41, and so forth are appropriately sellable in accordance with the type of a sheet S to be conveyed, for example.

It is also to be understood that the present disclosure is of course applicable to any other image forming apparatus than a monochrome printer as illustrated in FIG. 1, such as a color printer, monochrome and color copiers, a digital multifunction peripheral, a facsimile machine, or the like, and a sheet post-processing apparatus connected to an image forming apparatus.

The present disclosure is usable in image forming apparatuses such as a copier, a printer, a facsimile machine, and the like that is provided with a conveyance guide disposed on the upstream side of a transfer nip. By using the present disclosure, it is possible to provide an image forming apparatus that is capable of effectively reducing the fluttering of a recording medium on the upstream side of a transfer nip, and that is also capable of reducing the conveyance load when a stiff recording medium is conveyed.

What is claimed is:

1. An image forming apparatus comprising:

an image carrier;

a transfer member which transfers a toner image formed on the image carrier onto a recording medium;

a registration roller pair which conveys the recording medium to a transfer nip between the transfer member and the image carrier with a predetermined timing; and a conveyance guide which includes a first conveyance guide which faces an image-carrier-side surface of the recording medium conveyed from the registration roller pair to the transfer nip, and a second conveyance guide which faces a transfer-member-side surface of the recording medium, wherein the second conveyance guide has a main body portion which has a projecting portion which projects toward the first conveyance guide most in a recording-medium conveyance path from the registration roller pair to the transfer nip, a step portion which is formed on a downstream side of the projecting portion with respect to a recording-medium conveyance direction so as to be adjacent to the projecting portion, and a leading end portion which extends on a downstream side of the step portion with respect to the recording-medium conveyance direction to be close to the transfer nip, an elastic member which projects toward the first conveyance guide beyond a plane passing through a downstream-side end part of the projecting portion and a downstream-side end part of the step portion with respect to the recording-medium conveyance direction, and a film member which covers, over an entire region in a width direction perpendicular to the recording-medium conveyance direction, a surface of the main body portion that faces the first conveyance guide, together with the elastic member, and the elastic member is a rectangular parallelepiped sponge, and fixed to the step portion along the width direction such that a downstream-side corner part of the sponge with respect to the recording-medium conveyance direction projects beyond the plane toward the first conveyance guide.

2. The image forming apparatus of claim 1,
wherein
the film member is electrically conductive.

3. The image forming apparatus of claim 2,
wherein
the film member is grounded via the main body portion.

4. The image forming apparatus of claim 1,
wherein
the film member is grounded via a resistor having a resistance of an order of mega-ohms.

5. The image forming apparatus of claim 1,
wherein
the film member is an ultra-high molecular weight polyethylene sheet.

6. The image forming apparatus of claim 1,
wherein
the recording-medium conveyance path is a reverse-V shaped path which is inclined once upward from the registration roller pair and then downward toward the transfer nip.

7. An image forming apparatus comprising,
an image carrier;
a transfer member which transfers a toner image formed on the image carrier onto a recording medium;
a registration roller pair which conveys the recording medium to a transfer nip between the transfer member and the image carrier with a predetermined timing; and
a conveyance guide which includes
a first conveyance guide which faces an image-carrier-side surface of the recording medium conveyed from the registration roller pair to the transfer nip, and
a second conveyance guide which faces a transfer-member-side surface of the recording medium,
wherein
the second conveyance guide has
a main body portion which has
a projecting portion which projects toward the first conveyance guide most in a recording-medium conveyance path from the registration roller pair to the transfer nip,
a step portion which is formed on a downstream side of the projecting portion with respect to a recording-medium conveyance direction so as to be adjacent to the projecting portion,
an elastic member which projects toward the first conveyance guide beyond a plane passing through a downstream-side end part of the projecting portion and a downstream-side end part of the step portion with respect to the recording-medium conveyance direction, and
a film member which covers, over an entire region in a width direction perpendicular to the recording-medium conveyance direction, a surface of the main body portion that faces the first conveyance guide, together with the elastic member, and
in the second conveyance guide,
a downstream-side ridge line of the elastic member with respect to the recording-medium conveyance direction is a straight line, and
an easily deformable portion is provided in part of the elastic member in the width direction over which the recording medium having a minimum width-direction dimension passes, the easily deformable portion being easier to elastically deform than another portion of the elastic member.

8. The image forming apparatus of claim 7,
wherein
the elastic member is a rectangular parallelepiped sponge, and fixed to the step portion along the width direction such that a downstream-side corner part of the elastic member with respect to the recording-medium conveyance direction projects beyond the plane toward the first conveyance guide, and
the easily deformable portion is a recessed portion where an upstream-side ridge line of the elastic member with respect to the recording-medium conveyance direction is recessed toward the downstream side.

9. The image forming apparatus of claim 7,
wherein
the elastic member is an elastic sheet of which one end part is fixed to the projecting portion along the width direction, and of which an other end part projects over the step portion so as to overlap the step portion, and
the easily deformable portion is a thin-walled portion at which a thickness of the elastic sheet is smaller than at another part thereof.

10. The image forming apparatus of claim 7,
wherein
the elastic member is an elastic sheet of which one end part is fixed to the projecting portion along the width direction, and of which an other end part projects over the step portion so as to overlap the step portion, and
the easily deformable portion is formed of a material that has a lower elasticity modulus than a material of another part of the elastic sheet.

11. The image forming apparatus of claim 7,
wherein
a width-direction dimension of the easily deformable portion is equal to or larger than a width-direction dimension of the recording medium that has a minimum width allowed to pass the recording-medium conveyance path.

* * * * *